United States Patent [19]

Purr

[11] 4,413,948

[45] Nov. 8, 1983

[54] DOUBLE SHELL STEAM TURBINE HOUSING ASSEMBLY

[75] Inventor: Gerhard Purr, Mülheim-Ruhr, Fed. Rep. of Germany

[73] Assignee: Kraftwerk Union Aktiengesellschaft, Mülheim-Ruhr, Fed. Rep. of Germany

[21] Appl. No.: 400,582

[22] Filed: Jul. 21, 1982

[30] Foreign Application Priority Data

Jul. 31, 1981 [DE] Fed. Rep. of Germany ..... 3130376

[51] Int. Cl.[3] ..... F01D 25/26; F01D 25/28

[52] U.S. Cl. ..... 415/219 R; 248/637; 74/110

[58] Field of Search ..... 415/219 R, 134, 136; 248/637, 646, DIG. 1; 74/110

[56] References Cited

U.S. PATENT DOCUMENTS

| | | | |
|---|---|---|---|
| 186,967 | 2/1877 | Wilson | 74/110 |
| 2,249,397 | 7/1941 | Pateras Pescara | 74/110 |
| 3,594,095 | 7/1971 | Werner | 415/219 |
| 3,613,465 | 10/1971 | Wood | 74/110 |
| 3,881,843 | 5/1975 | Meylan | 415/219 R |
| 4,102,213 | 7/1978 | Smith | 74/110 |

*Primary Examiner*—Harvey C. Hornsby
*Assistant Examiner*—John Kwon
*Attorney, Agent, or Firm*—Herbert L. Lerner; Laurence A. Greenberg

[57] ABSTRACT

Double shell steam turbine housing assembly having an inner housing and an outer housing separated from the inner housing, a base plate and lateral support arms supporting the inner housing on the base plate, including centering guide means for maintaining the inner housing in a central position, the centering guide means including a double-armed lever connected to the inner housing and a pair of elongated guide bars secured, respectively, at mutually opposite sides of the housing assembly to the base plate and articulatingly connected, respectively, to opposite ends of the double-armed lever, the guide bars extending through the outer housing.

6 Claims, 3 Drawing Figures

DOUBLE SHELL STEAM TURBINE HOUSING ASSEMBLY

The invention relates to a double shell steam turbine housing assembly and, more particularly, to such a housing assembly having an inner housing and an outer housing separated from the inner housing, a base plate, lateral support arms supporting the inner housing on the base plate, and centering guide means for maintaining the inner housing in a central position.

A steam turbine housing of the foregoing general type is known from German Published, Non-Prosecuted Application (DE-OS) No. 22 00 447. In this heretoforeknown structural type, the inner housing is supported on a table base plate by means of lateral bearing or support arms, whereas the outer housing is supported directly on the machine housing base plate by means of a condenser disposed below it. The lateral support arms of the inner housing are enclosed, respectively, by steamtight housing projections of the outer housing, the mobility of the outer housing in relation to the table base plate, in the vicinity of the support points, being ensured by bellows-like compensators. In order to maintain the inner housing in a central position, a central guiding device is provided. In the aforementioned heretofore-known type of structure, this central guiding device is in the form of a strap secured to the inner housing and engaging above a guide bar running in an axial direction, the ends of the guide bar being anchored in the table base plate. The guide bar is a beam or bracket fixed on two sides thereof which is flexibly or elastically distorted by the displacement forces acting upon the inner housing. These flexible or elastic deflections of the guide bar result, however, in a corresponding eccentric positioning of the inner housing.

It is accordingly an object of the invention to provide a double shell steam turbine housing assembly wherein the central guidance of the inner housing thereof is as accurate as possible.

With the foregoing and other objects in view, there is provided, in accordance with the invention, a double shell steam turbine housing assembly having an inner housing and an outer housing separated from the inner housing, a base plate and lateral support arms supporting the inner housing on the base plate, comprising centering guide means for maintaining the inner housing in a central position, the centering guide means including a double-armed lever connected to the inner housing and a pair of elongated guide bars secured, respectively, at mutually opposite sides of the housing assembly to the base plate and articulatingly connected, respectively, to opposite ends of the double-armed lever, the guide bars extending through the outer housing.

In the case of the steam turbine housing assembly according to the invention, any displacement forces acting on the inner housing are absorbed by two guide bars, which are secured to the base plate, on mutually opposite sides of the housing assembly, and are articulatingly connected to the inner housing by the ends of a double-armed lever. Depending upon the direction of the lateral displacement forces, one of the guide bars is thereby subjected to tension and the other to compression, the tensile and the compression forces, respectively, being, however, only half as great as the displacement forces. Exceedingly precise centering of the inner housing is thereby assured. The exact centering of the inner housing should not be influenced by temperature-dependent variations in the length of the guide bars, since these variations in length are equal when temperature distribution is uniform, and are compensated by a corresponding rotary or pivotal movement of the double-armed lever, while simultaneously maintaining the central position of the inner housing. If, under certain operational conditions, an uneven temperature distribution in the region surrounding the guide bars must be expected, then this can be compensated for suitably by having the guide bars enclosed by a common protective tube, in accordance with another feature of the invention. The protective tube is able to maintain substantially uniform temperature distribution within the tube, and therefore substantially uniform expansion of the guides, even when different temperatures prevail along the length of the tube at the outside thereof.

In accordance with a further feature of the invention, the enclosure of the guide bars is in a steamtight manner yet affords thermal extensibility of the guide bars.

In accordance with an added feature of the invention, a fork is secured to the inner housing, and the double-armed lever is pivotally supported on a pivot pin carried by the fork.

In accordance with an additional feature of the invention, at least one of the guide bars is adjustable in length. Centering of the inner housing can thereby be set or subsequently adjusted in a relatively simple manner along the length of one or both of the guide bars.

In accordance with a concomitant feature of the invention, the housing assembly is for a low-pressure steam turbine.

Other features which are considered as characteristic for the invention are set forth in the appended claims.

Although the invention is illustrated and described herein as embodied in a double shell steam turbine housing assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
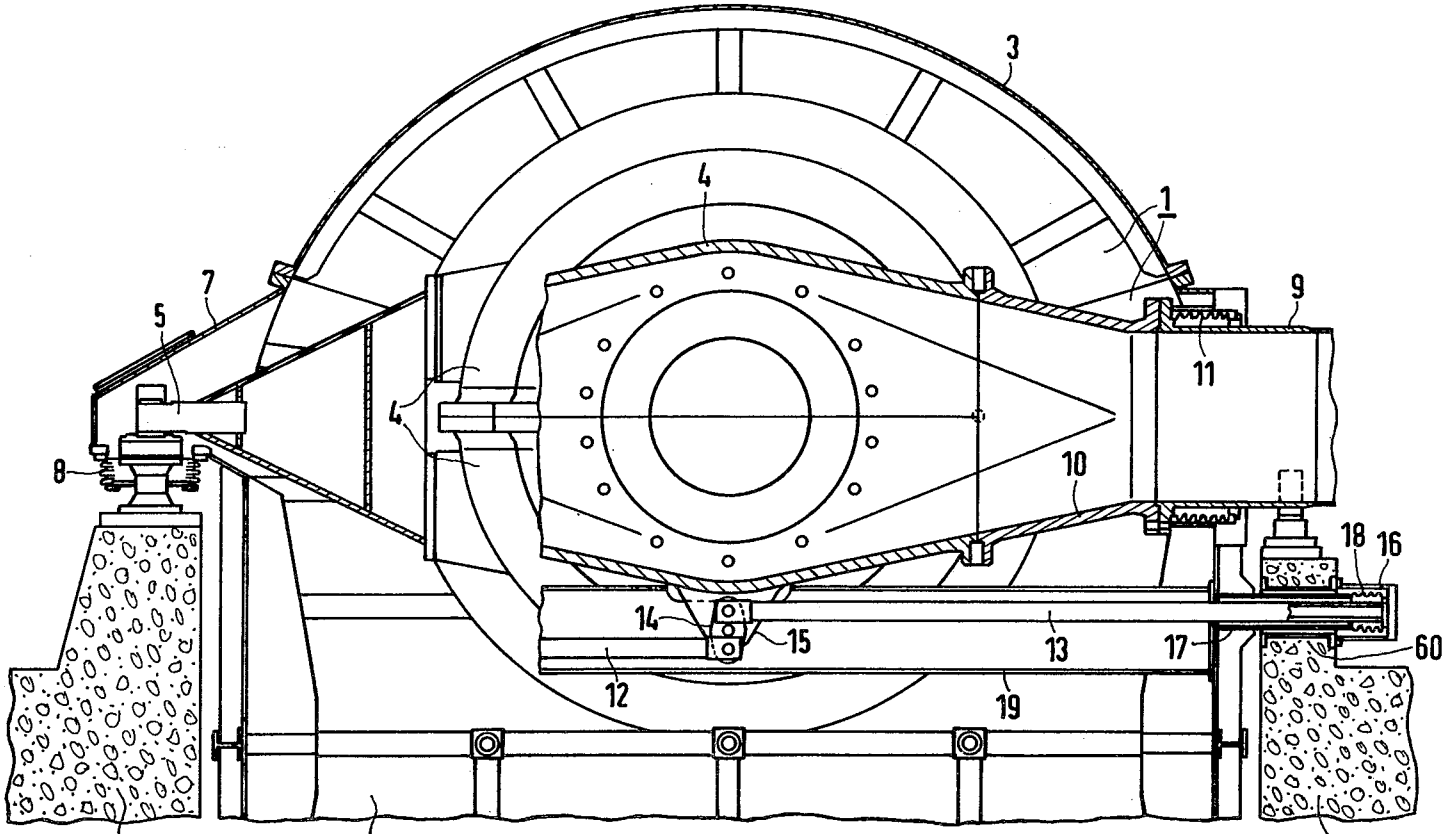
FIG. 1 is a cross-sectional view of a double shell steam turbine housing assembly according to the invention showing guide bars articulatingly connected to an inner housing thereof.

Referring now to the drawings and first, particularly, to FIG. 1 thereof, there is provided a cross-sectional view of a double shell low-pressure steam turbine housing having an outer housing 1 formed of an outflow part or section 2 and an outflow hood 3. The outflow part 2, which is reinforced by non-illustrated ribs and which may also be described as the lower part or section of the outer housing 1, is formed by the extended dome walls of a condenser disposed on a non-illustrated machine housing base plate. The entire outer housing 1 is thus supported on the machine housing base plate by means of the non-illustrated condenser. Support of an inner housing 4 which is disposed within the outer housing 1 and is divided along a horizontal axial plane, is effected by altogether four lateral bearing or supporting arms 5 resting on a table base plate 6. These four supports 5 of the inner housing 4 on the table base plate 6 are enclosed, respectively, by steamtight housing extensions 7 of the outer housing 1, mobility of the outer housing 1 relative to the table base plate 6 being assured by bellows-like compensators 8. In the cross-sectional view according to FIG. 1, only one of the four supports 5 of the inner housing 4 described hereinbefore is shown at the left-hand side of the drawing.

The supply of steam to the inner housing 4 is effected by two steam supply lines 9, in all, which penetrate the wall of the outflow part 2 and are connected to the inner housing 4 by means of conical transition parts or sections 10. Of these two steam supply lines 9, which are respectively aligned perpendicularly to the two longitudinal or elongated sides of the low-pressure steam turbine housing assembly, only one of the lines 9 is shown at the right-hand side of the drawing in the cross-sectional view according to FIG. 1. The through-passages or lead-throughs of the steam supply lines 9 provided in the walls of the outflow part 2 are of steamtight construction, respectively, by the use of flexible bellows-like compensators 11.

Figure 2:
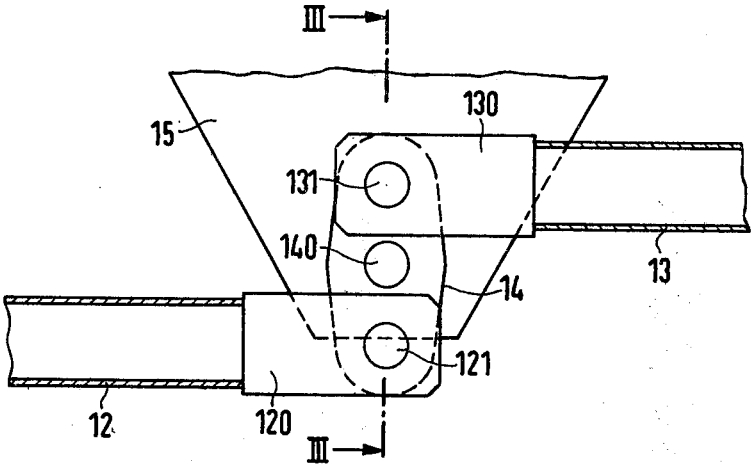
FIG. 2 is an enlarged fragmentary view of FIG. 1 showing the connection of the guide bars to the inner housing in greater detail.
Figure 3:
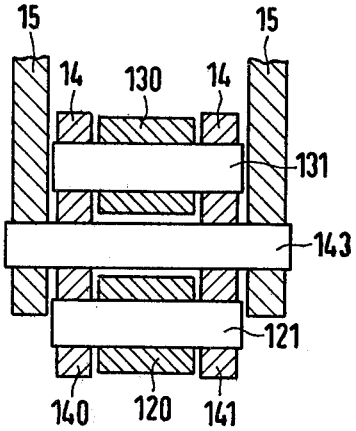
FIG. 3 is a sectional view of FIG. 2 taken along the line III—III in direction of the arrows.

The tubular forces issuing from the hereinafore-described steam supply lines 9 could lead to lateral displacement or shifting of the inner housing 4. To be able to keep radial play to a minimum, a central guide system is provided, which should ensure central positioning of the inner housing 4. This central guide system is made up of two elongated guides in the form of guide bars 12 and 13 extending transversely to the axis of the housing assembly. The guide bars 12 and 13 pass through the walls of the outflow part 2 in a steamtight manner and are secured to the table base plate 6 on mutually opposite sides of the housing assembly. The inner ends of the two guide bars 12 and 13 are articulatingly connected to the inner housing 4 by means of the ends of the double-armed lever 14, the construction of the articulating connection being shown in greater detail in FIGS. 2 and 3. The guide bars 12 and 13 are connected to respective stub heads 120 and 130, which are, in turn, connected to the ends of the double-armed lever 14 by means of respective cross-pins 121 and 131. The double-armed lever 14 is formed of two lateral parts 140 and 141, which receive the stub heads 120 and 130, respectively, therebetween and are connected to one another by means of two cross pins 121 and 131. The double-armed lever 14 has a rotational axis or shaft formed by a rotary pin 143, which is disposed exactly centrally between the cross pins 121 and 131, and, further, has ends held in a fork 15. The fork 15 is rigidly connected to the underside of the inner housing 4 and is arranged in such a way that the rotary pin 143 lies precisely in a vertical axial plane of the low-pressure steam turbine housing assembly.

As mentioned hereinafore, the through-passages or lead-ins of the guide bars 12 and 13 extending through the walls of the outflow part 2 must be effected in a steamtight manner. This can be achieved, for example, by compensators which are secured at one end to the guide bars 12 and 13, respectively, and at the other end directly to the corresponding walls of the outflow part 2. At the right-hand side of the cross-sectional view according to FIG. 1, a sealing arrangement is shown which diverges therefrom and shifted or displaced outwardly, and which ensures ready access to the compensators. The guide bar 13 penetrates the wall of the outflow part 2 and a support or pedestal 60 on the table base plate 6, the outer end of the guide bar 13 being supported by means of a retaining cap 16 on the rear side or face of the holder 60. Flexible sealing can then be shifted into the region within the retaining cap 16 by means of a tube 17 connected to the outflow part 2 in a steamtight manner, the tube 17 surrounding the guide bar 13 and likewise passing through the support or pedestal 60. In addition thereto, a compensator 18 is provided, which is readily accessible when the retaining cap 16 is removed, and which is connected to the outer end of the tube 17 and to the outer end of the guide bar 13. A further advantage of this arrangement is that the length of the guide bar 13 can be adjusted by means of spacers disposed between the outer end of the guide bar 13 and the frontal or end face of the retaining cap 16. The central position of the inner housing 4 is then especially easy to adjust by means of this adjustment of the length of the guide bar 13 and a corresponding adjustment of the length of the guide bar 12.

The central guiding system of the inner housing 4 described hereinbefore is insensitive to variations in temperature, because equal variations in length of the guide bars 12 and 13 are compensated by a corresponding turning or twisting of the double-armed lever 14, while simultaneously maintaining the central position. Only a non-uniform distribution of temperatures in the region of the guide bars 12 and 13 could effect a given lateral displacement of the inner housing 4. In order to avoid this, the two guide bars 12 and 13 are therefore enclosed by a common protective tube 19, which extends between the mutually opposite walls of the outflow part 2 and has only a small recess to permit through-passage or lead-in of the fork 15. This protective tube 19 balances out optionally any uneven distributions of temperatures and thus ensures even or uniform heating (inside the tube) of the guide bars 12 and 13.

In the hereinafore-described embodiment of the invention, only one central guiding system is provided, which is arranged centrally in axial direction. Should greater displacement forces occur, however, it would also be possible to provide two or more central guiding systems of this type which are disposed in displaced or offset relationship to one another in axial direction.

The foregoing is a description corresponding to German Application No. P 31 30 376.5, dated July 31, 1981, the International priority of which is being claimed for the instant application, and which is hereby made part of this application. Any discrepancies between the foregoing specification and the corresponding German application are to be resolved in favor of the latter.

I claim:

1. Double shell steam turbine housing assembly having an inner housing and an outer housing separated from the inner housing, a base plate and lateral support arms supporting the inner housing on the base plate, comprising centering guide means for maintaining the inner housing in a central position, said centering guide means including a double-armed lever connected to the inner housing and a pair of elongated guide bars secured, respectively, at mutually opposite sides of the housing assembly to the base plate and articulatingly connected, respectively, to opposite ends of said double-armed lever, said guide bars extending through the outer housing.

2. Housing assembly according to claim 1, including means for enclosing said guide bars in a steamtight manner yet affording thermal extensibility of said guide bars.

3. Housing assembly according to claim 2, wherein said enclosing means include a common protective tube surrounding both of said guide bars.

4. Housing assembly according to claim 1, including a fork secured to the inner housing, said double-armed lever being pivotally supported on a pivot pin carried by said fork.

5. Housing assembly according to claim 1, wherein at least one of said guide bars is adjustable in length.

6. Housing assembly according to claim 1, wherein the housing assembly is for a low-pressure steam turbine.

* * * * *